US006769586B1

(12) United States Patent
Beletsky et al.

(10) Patent No.: US 6,769,586 B1
(45) Date of Patent: Aug. 3, 2004

(54) ERGONOMIC DUTY BELT AND HOLSTER BELT LOOP ASSEMBLY

(75) Inventors: Robert J. Beletsky, Fallbrook, CA (US); Anthony G. Lefeber, Temecula, CA (US)

(73) Assignee: Bianchi International, Temecula, CA (US)

( * ) Notice: Subject to any disclaimer, the term of this patent is extended or adjusted under 35 U.S.C. 154(b) by 30 days.

(21) Appl. No.: 10/214,752

(22) Filed: Aug. 7, 2002

Related U.S. Application Data

(60) Provisional application No. 60/311,272, filed on Aug. 9, 2001.

(51) Int. Cl.[7] ..... A45C 1/04

(52) U.S. Cl. ..... 224/662; 224/674; 224/677; 224/678; 224/912

(58) Field of Search ..... 224/193, 662, 224/663, 665, 671, 672, 674, 677, 678, 911, 912

(56) References Cited

U.S. PATENT DOCUMENTS 3,642,183 A * 2/1972 Boren ..... 224/674
3,882,914 A * 5/1975 Strutz ..... 224/619
4,682,587 A 7/1987 Curlee
4,747,527 A * 5/1988 Trumpower, II ..... 224/662
4,898,310 A 2/1990 Remington
5,152,443 A 10/1992 Hagan
5,372,288 A 12/1994 Rogers et al.
5,386,593 A * 2/1995 Kleinman ..... 2/322
5,544,794 A * 8/1996 Nichols ..... 224/667
5,641,100 A * 6/1997 Mitchell et al. ..... 224/198
6,164,509 A 12/2000 Gausling et al.
6,398,092 B1 * 6/2002 Ansley ..... 224/582
6,588,639 B2 * 7/2003 Beletsky et al. ..... 224/672

* cited by examiner

*Primary Examiner*—Stephen K. Cronin
(74) *Attorney, Agent, or Firm*—John E. Wagner; Sam Bernardo

(57) ABSTRACT

An ergonomic duty belt and ergonomic holster and belt loop assembly are disclosed which cooperate to provide a stable platform for a handgun in a holster and other accessories as well while providing superior comfort for the wearer. The ergonomic belt effectively has two widths, a narrow 1½ vertical effective width, which is against the wearer's body, and a traditional 2¼ inch exterior vertical width, which is sized to support the wearer's gear, such as a holster and a weapon. That portion of the ergonomic belt, which is against the wearer, is also padded for additional comfort. The ergonomic holster includes a belt loop assembly which is tapered and padded on its inner surface in the area where the assembly touches the wearer's body when worn as intended to better conform to the body of the wearer and minimize wearer discomfort.

21 Claims, 4 Drawing Sheets

Fig. 1a
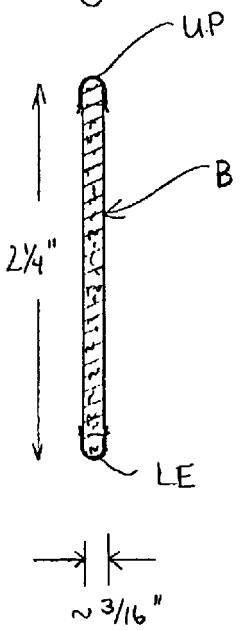
Fig. 3b
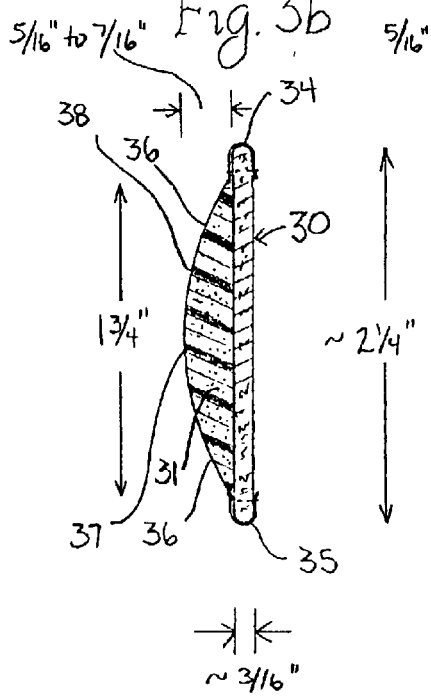
Fig. 3c
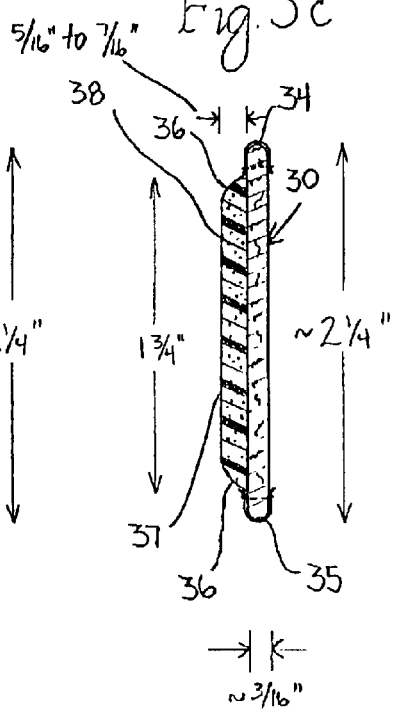
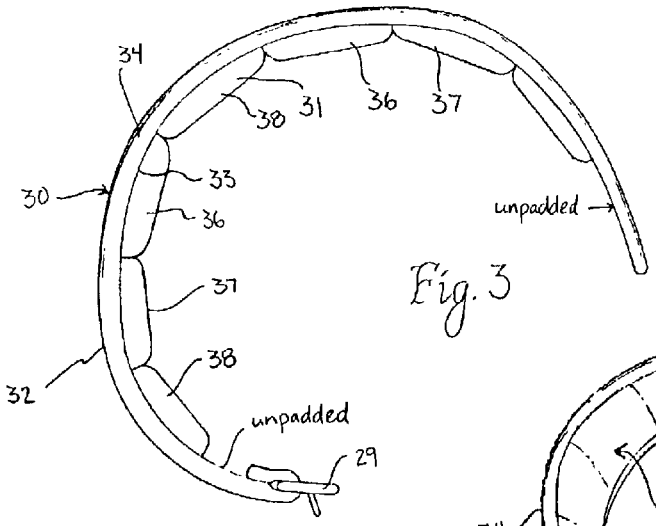
Fig. 3
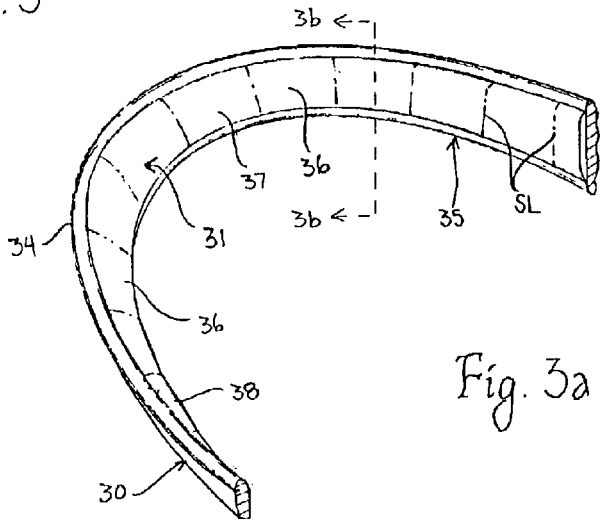
Fig. 3a

ERGONOMIC DUTY BELT AND HOLSTER BELT LOOP ASSEMBLY

REFERENCE TO RELATED APPLICATION

This non-provisional patent application claims benefit of U.S. provisional patent serial No. 60/311,272, filed Aug. 9, 2001, and hereby claims the benefit of the embodiments therein and of the filing date thereof.

BACKGROUND OF THE INVENTION

Almost all uniformed law enforcement officers wear a duty belt. Duty belts or the like are also frequently worn by military personnel. A duty belt is that platform primarily used for carrying gear, such as a handgun holster, baton, and handcuffs, which the wearer must have within an arms length reach at all times. In recent years, the number of items normally carried on duty belts has increased. Correspondingly, the weight carried by the average duty belt has also increased.

Holsters are one of the items which law enforcement officers or military personnel normally hang from a duty belt. The holster is generally connected to the duty belt by way of a holster belt loop assembly. It is well known in the art that duty belts have a certain minimum width, i.e., vertical dimension when worn; otherwise, they are a less effective platform for supporting gear. Further, tradition and style have also dictated duty belt width. For these reasons, duty belts have traditionally been in the order of 2¼ inches wide. This width of a relatively stiff material provides a solid support for all carried items, particularly the holster and its handgun, usually the heaviest item carried on the duty belt.

It has been suggested that duty belts having a more narrow width might be more comfortable to the wearer because a narrower belt may reduce the likelihood of the edges of the belt digging into the wearer's rib section and/or thigh area. Consequently, for comfort, many individuals might prefer a duty belt having a width less than 2¼ inches.

It has been thought that it was almost impossible to design a single duty belt having the aforementioned desired characteristics of holster stability and comfort. Therefore, a choice had to be made between a narrower belt, which might be more comfortable but less effective, in properly supporting the wearers gear, and a wider belt, which may be less comfortable, but a more effective platform for supporting gear. It was believed that any comfort benefit obtained by reducing the width of the duty belt was outweighed by the weakening of the platform supporting the wearer's gear. Thus, the traditional duty belt has remained 2¼ inches wide, and little has been done in recent years to improve the ergonomic comfort and other factors of the traditional duty belt.

Duty holsters are normally hung from belt by a belt loop assembly, which is typically 2 to 3 inches wide (horizontal dimension when worn). Many holster belt loop assemblies are S-shaped so as to extend the holster and thus weapon slightly away from the wearer's body to make the weapon more easily accessible, provide a space for the wearer's coat or jacket, and position the holster where it is less likely to rub against the wearer's leg. The S-shaped design also conforms to some degree to the hip of the wearer. Holster belt loop assemblies, more recently, are almost always made of a rigid, relatively inflexible plastic material, so the holster will remain fixedly positioned at all times.

The S-shaped design incorporates a ridge at its centermost region for strength and rigidity. Because the ridge is made from rigid materials, it can be a source of discomfort, if the ridge of the S-shape design puts pressure on the hip or thigh of the wearer.

It would be a great advantage to all individuals whose job necessitates that they wear a duty belt or duty belt with holster to have a duty belt and holster which, together, reduce, if not eliminate, the likelihood of the wearer experiencing discomfort, while simultaneously providing the wearer with a duty belt and holster which provides the reliability and stability of the traditional duty belt for their intended purpose.

BRIEF SUMMARY OF THE INVENTION

Applicants have invented a single duty belt which effectively has two different widths, a more comfortable narrow interior width, which is against the wearer's body, and a wider exterior width, which is wide enough to support all of the wearer's gear with the same efficiency as a traditional width duty belt.

The applicants have modified the traditional 2¼-inch duty belt to include a raised foam padded inner belt liner. The inner foam pad, ideally, is the only contact with the wearer through his clothing. The top and bottom portions of the inner foam belt liner are gently beveled, so as to reduce the amount of actual belt area which comes into contact with the body of the wearer. Thus, the effective width of the inventive belt is less than the actual belt width due to the presence of the raised, padded, inner belt liner. For example, the interior portion of the inventive duty belt may have an effective width of, for example, 1½ inches or 1¾ inches, while the width of the exterior portion of the same duty belt is 2¼ inches. At these widths, the duty belt is more comfortable than the traditional 2¼-inch duty belt, but just as supportive and stable for the gear carried. The foam inner belt liner also includes padding for additional comfort to the wearer. In effect, the ergonomic belt of this invention acts like two different belts, a comfortable, narrow, padded belt in contact with the wearer's torso, and a wide, stable belt for carrying duty equipment.

The duty belt of this invention allows the wearer to experience both the comfort of wearing a more narrow belt and the piece of mind in knowing that the necessary gear is hung from a stable and supportive platform. Thus, when the wearer reaches for gear, the gear will be easily retrieved because it was properly supported by the duty belt.

Faced with the objections of holsters rubbing against the wearer's body, applicants have also invented a mating holster, including an improved belt loop assembly, which complements the aforementioned duty belt and which substantially reduces or eliminates the ridge found in the traditional S-shaped holster belt loop assembly.

Reducing the ridge of the S-shaped holster belt loop assembly aids in reducing, if not eliminating, discomfort caused by the ridge exerting pressure upon the wearer's hip or thigh. The belt loop assembly of the holster also includes soft padding on the surface facing the wearer. The location of the padded surface is in that area where the holster belt loop assembly is most likely to come into contact with the wearer's hip and/or thigh. The modification to the belt loop assembly's design, as well as the addition of padding, provides wearer's of a duty belt worn holster with a holster which is more comfortable to wear during all phases of duty, from everyday wear to foot pursuit.

Together, the applicants' duty belt and holster, with its improved belt loop assembly, provide the wearer with comfort in knowing that his/her gear will remain stable on the duty belt, while also providing the wearer with additional physical comfort, heretofore unknown with traditional duty belts and S-shaped holster belt loop assemblies. The belt loop assembly of this invention may be adapted to most belt-worn holsters.

BRIEF DESCRIPTION OF THE DRAWINGS

This invention may be more clearly understood with the following detailed description and by reference to the drawings in which:

FIG. 1*a* is a vertical sectional view through the traditional duty belt of FIG. 1 taken along lines 1*a*—1*a* of FIG. 1;

FIG. 3 is a top fragmentary plan view of the duty belt of this invention;

FIG. 3*a* is a fragmentary perspective view of the duty belt if FIG. 3;

FIG. 3*b* is a vertical sectional view through the inventive duty belt of FIG. 3 taken along the lines 3*b*—3*b* of FIG. 3*a;*

FIG. 3*c* is an alternative embodiment of the inventive duty belt of FIG. 3*b* showing a rounded interior contact area;

DETAILED DESCRIPTION

Figure 1:
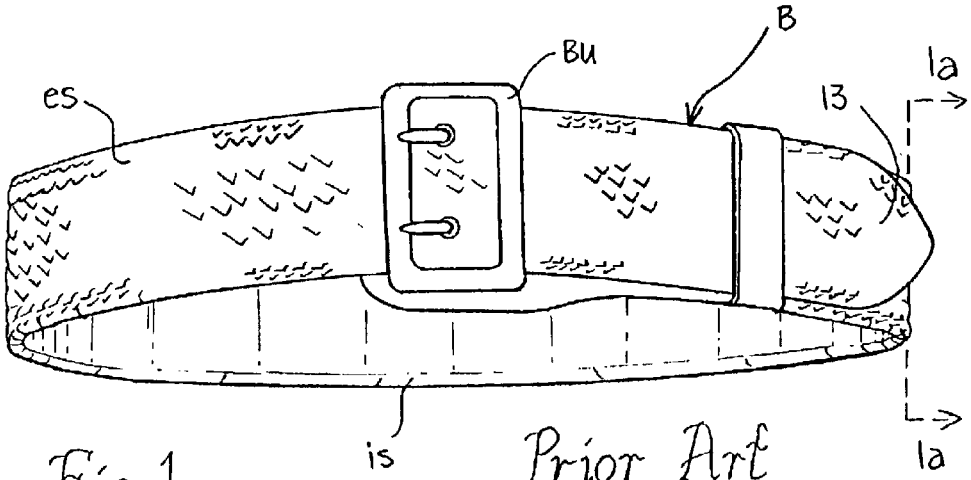
Fig. 1 Prior Art
FIG. 1 is a front side view of a traditional prior art 2¼-inch leather duty belt.

Throughout this specification, reference letters are used to designate the prior art and reference numerals to designate this invention.

FIG. 1 illustrates a traditional 2¼-inch vertical width prior art duty belt B. Both the interior surface IS and exterior surface ES of duty belt B are in the order of 2¼ inches wide and approximately 3/16 inches thick. The 2¼-inch vertical width belt is considered to be the optimum width belt that is strong enough to support various types of gear, such as a holster with weapon, which may be required by the wearer. Except for buckle BU for adjustment, the traditional duty belt design has no significant means for altering the degree of comfort of belt B. Although the edges E of belt B are rounded or include an edge binding edges can, for example, when the wearer is seated, dig into the. wearer's rib cage or hip area soft tissue and cause discomfort. Also illustrated here is the fact that there is little, if any, padding on the interior surface IS to make the belt B more comfortable to the wearer.

FIG. 1*a* is a cross section of typical prior art belt B of FIG. 1 along 1*a* of FIG. 1, and specifically illustrates the upper edge UE and lower edge LE, as presenting relatively sharp edges which, in some instances, cause discomfort to the wearer. The belt B of FIG. 1*a* is often of top grain leather or a leather substitute, such as trilaminate, as disclosed in U.S. Pat. No. 5,351,868.

FIG. 2*a* illustrates a prior art holster H used with a belt of FIG. 1*a*, its belt loop assembly BL with an S-shaped configuration having a pronounced ridge R. Belt loop assembly BL attaches to holster body H, typically by three fasteners at its lower attachment end region LE and at the top end includes an integral belt loop receives a duty belt (unshown) having a cross section of FIG. 1*a*. Belt loop assembly BL must be relatively rigid so it can firmly position holster H along duty belt B. Belt loop assembly BL is normally made from a lightweight, but rigid, plastic material or a non-flexible material, such as leather or fabric, with an internal metal stiffener. Because of the stiffness of holster belt loop assembly and the presence of ridge R, belt loop assembly BL may, in certain circumstances, press against the thigh or hip region of the wearer and cause discomfort.

Figure 2:
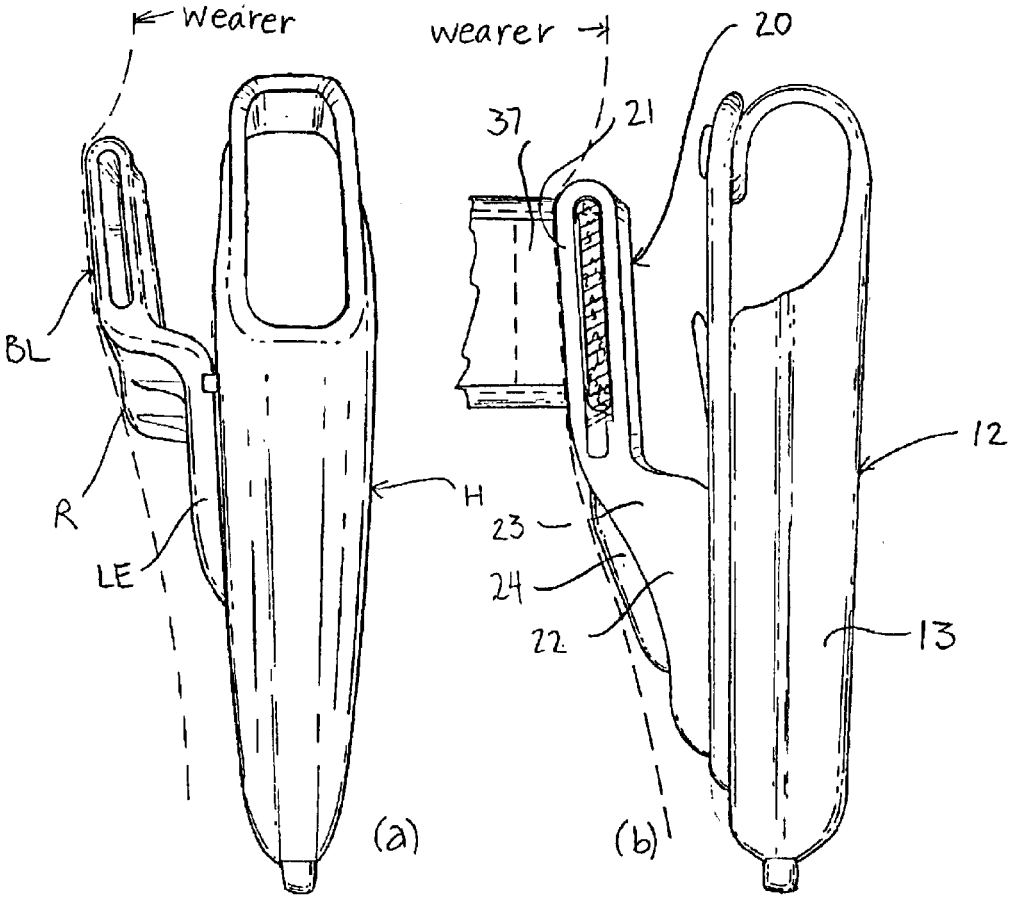
Fig. 2 Prior Art
FIG. 2*a* is a front elevational view of a prior art plastic holster belt loop assembly, with a leather holster body attached.
FIG. 2*b* is a front elevational view of a holster employing the improved belt loop of this invention.
Figure 4:
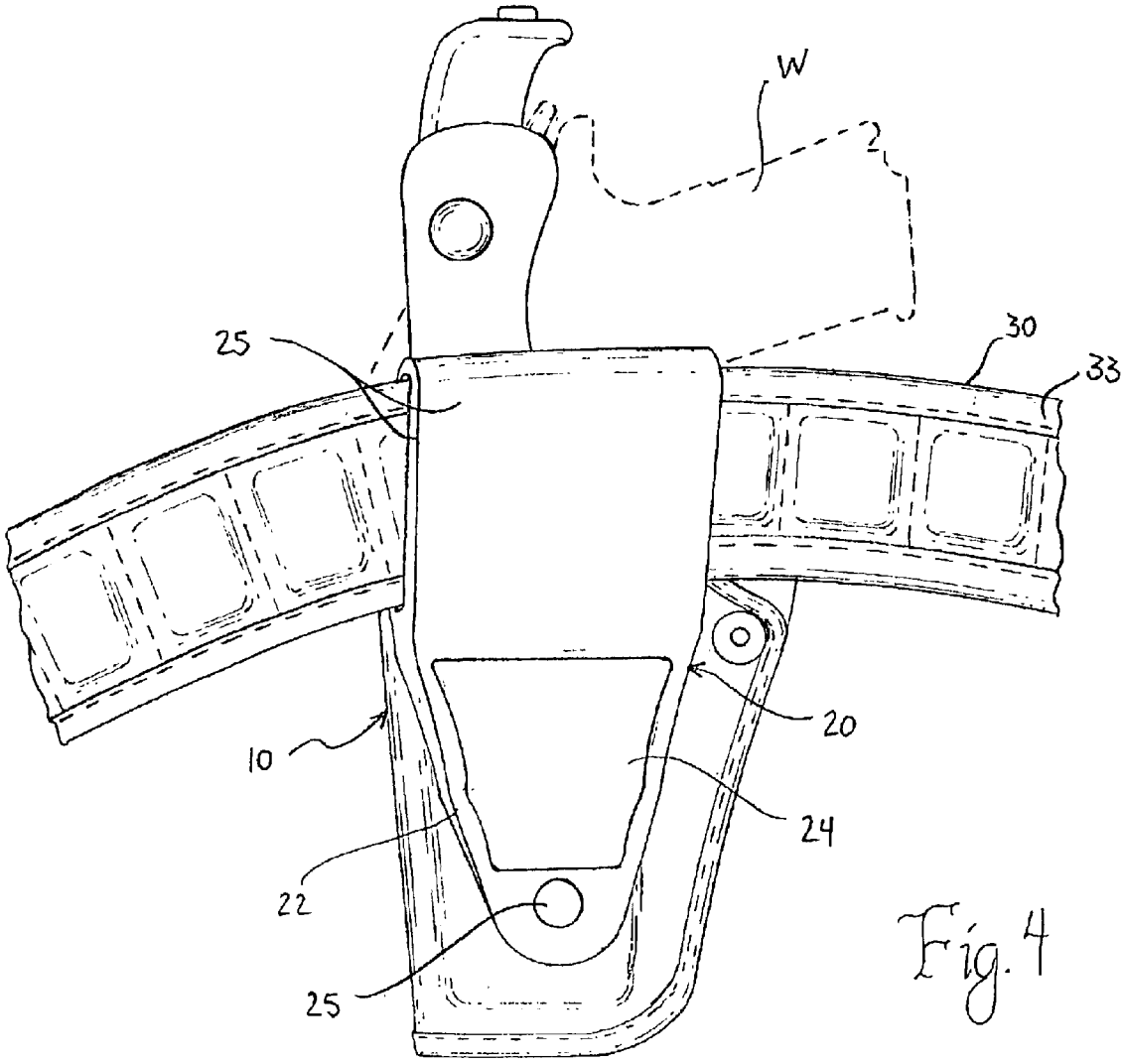
FIG. 4 is a fragmentary perspective view of the inner side of the inventive duty belt of FIG. 3 illustrating the inner face of the inventive holster belt loop assembly with padding, attached to a holster holding a weapon.

FIG. 2(*b*) shows a holster 10 in accordance with this invention, including an improved belt loop assembly 20, including a belt loop portion 21 and an attachment portion 22. Visible also is a transition portion 23 of the belt loop assembly 20, which includes a pad 24, best seen in FIG. 4. The pad 24 is generally trapezoidal shape as seen in FIG. 4 to match the shape of the transition section 24 of belt loop assembly 20 and constitutes the contact area with the wearer in the soft tissue of the hip area.

Turning now to FIG. 3, which illustrates the inventive belt 30 having fastening means, such as buckle 29 and a foam molded raised inner liner 31. Belt 30 may be made from a variety of materials, such as leather, ballistic weave nylon or laminate materials as disclosed in the co-pending patent application of Beletsky et al. filed Apr. 30, 2002, as Ser. No. 10/136,262. Duty belts, which are made of non-leather materials, often times weigh less than those made of leather; and for comfort, lighter weight belts may be preferred.

Belt 30 has an elongated body, including an outside surface 32, an inside surface 33, a top edge 34, and a bottom edge 35 (unshown in FIG. 3), where the edges are generally parallel, best seen in FIGS. 3*b* and 3*c*. The vertical width of the outside surface 32 of belt 30 is in the order of 2¼ inches, the same vertical width as the exterior portion 13 of the traditional prior art duty belt B of FIG. 2*a* and the desired thickness e.g., 3 1/16 inch, for securely supporting gear, such as a holster with handgun.

A molded foam raised inner liner 37 is a significant component of duty belt 30. The foam raised inner liner 31 extends inwardly from the inside surface 33 of belt 30 to a thickness generally ⅓ (128% to 150%) greater than the thickness of the belt 10, approximately 5/16-inch to 7/16-inch and has a bulging, slightly compressible fabric or skinned foam contact face 37 best seen in FIGS. 3*b* and 3*c*. The buckle 29 end and the opposite end regions are unpadded.

The presence of the foam raised inner liner 31 acts to eliminate duty belt-related discomfort in two significant ways. The first, and possibly most significant, way in which the foam raised inner liner 31 acts to minimize wearer discomfort is by its design. At both the top edge 34 and bottom edge 35 of duty belt 30, the foam raised inner liner 31 are contoured or beveled 36, best seen in FIGS. 3*b* and 3*c*. As a result of the contour of raised inner liner 31, a contact surface or face 37, best seen in FIGS. 3*b* and 3*c*, is created. Contact surface or face 37 of belt 30 is designed to be that portion of duty belt 30, which actually comes into contact with the wearer when the belt is worn in the intended manner, best seen in FIG. 2*a* as the dashed line denoting the clothing and torso of the wearer. Contact face 37 is narrower than the width of the outside surface 32 of belt 30. The vertical width of the inner contact face 37 is between about 1½ inches to 1¾ inches wide, with the preferred width being about 1½ inches. This spaces the edges 34 and 35 from the body of most wearers.

Thus, as a result of contact face 37, duty belt 30 provides the wearer with a single duty belt having two different effective widths. The interior width or effective wearer contact width of duty belt 30 is determined by the vertical width of contact face 37, which by its design is less than the duty belt's outside surface vertical width 32. Therefore, the duty belt 30 can provide the wearer with a single duty belt which has one interior vertical width designed for personal comfort, and another exterior vertical width designed as a safe and secure platform for supporting gear. Applicants are not aware of another duty belt truly having a dual vertical width feature.

The second significant way in which the foam raised inner liner 31 acts to minimize wearer discomfort is that raised liner 31 is made of a soft, yet firm, resilient material, such as a closed cell foam, which not only engages the wearer's waist, but cushions belt 30 against the waist and hip regions of the wearer. This feature becomes more significant when, for example, the total weight carried duty belt 30 increases with added accessories, such as a holstered handgun. It is not unusual for a duty belt with gear to weight as much as about 12 lbs.

The raised inner liner 31 may be made from any material which is not only soft enough to cushion belt 30 against the wearer but firm enough to support belt 30 against the wearer's waist. In the preferred embodiment, the foam material used to fill the raised inner liner 31 of belt 30 is made of polyethylene foam having a density of about 4 lbs. per cubic foot.

Raised inner liner 31 is attached to belt 30 by any means designed to securely fix liner 31 to belt 30, e.g., adhesive or stitching.

The foam raised inner liner 31 of belt 30 of FIG. 3 is covered with a soft, thin, durable cover 38 to protect the foam material and to give the duty belt inner liner 31 a neat professional appearance. In the preferred embodiment, durable cover 38 is made of 3000 Velcro® compatible loop material and may be attached to the foam raised inner liner 31 and duty belt 30 by any reasonable means, such as adhesive bonding or stitching, which securely attaches durable cover 38 to belt 30.

FIG. 3*a* illustrates the inventive inner belt liner 31 of belt 30, clearly showing the contour 36 near the top edge 34 and bottom edge 35 of the foam raised inner liner 31 defining contact face 37 therebetween. FIG. 3*a* also shows how contact face 37 effectively reduces the interior vertical width of the traditional 2¼-inch duty belt of FIG. 1 to a more ergonomically desirable vertical width of about 1½ inches, while concurrently maintaining the outside vertical width of belt 30 to the more desirable gear-supporting vertical width of 2¼ inches. Vertical stitch lines SL through the belt liner cover and foam (but normally not the belt 30) provides a number of cushions and provides a natural curvature to the belt.

Turning now to FIGS. 3*b* and 3*c*, which illustrate the distance by which contact face 37 extends away from the vertical plane of belt 30, which is between about 5/16 to 7/16 inches. FIG. 3*c* shows contact face 37 as being plateau shaped, e.g., having a flat surface, while FIG. 3*b* depicts contact face 37 of belt 30 having a rounded or dome raised shape. FIGS. 3*b* and 3*c* also show the dual vertical width feature of belt 30, with the exterior vertical width being significantly larger than the interior vertical width, e.g., 2¼-inch/1½-inch to 1¾-inch or 128% to 150% greater vertical width for the belt 30 than the cushioned support area 37.

Figure 5:
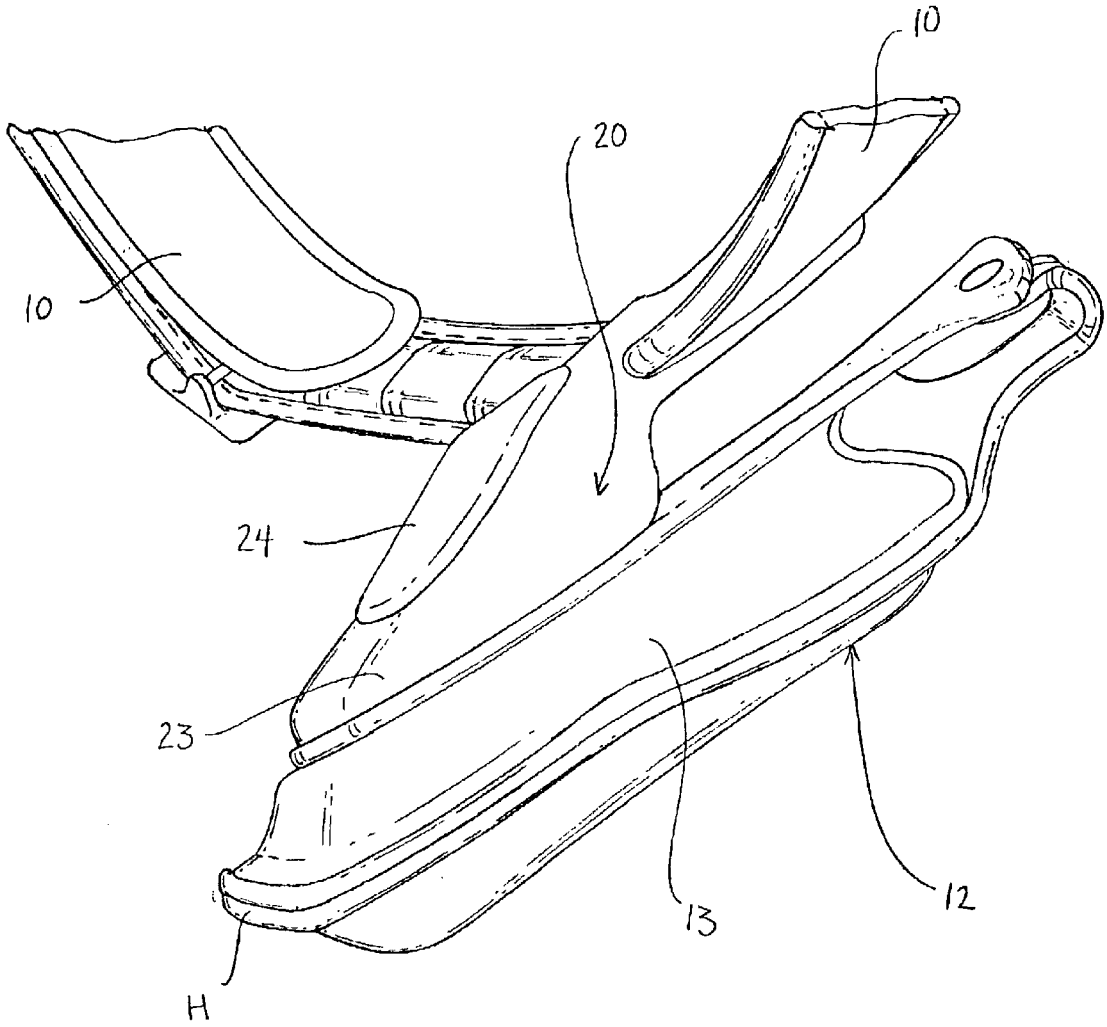
FIG. 5 is an underside perspective view of the inventive duty belt of FIG. 4 illustrating the inventive holster's belt loop assembly having padding attached to the holster holding a weapon.

In conjunction with the inventive duty belt 30, applicant has invented an improved holster, holster and belt loop assembly 40 seen in FIGS. 2*b*, 4, and 5 which complements and cooperates with the improved belt of this invention.

FIG. 4 illustrates the interior face 33 of duty belt 30 and the elongated body of the belt loop assembly 20, including a belt-receiving loop section 25 and a holster-attachment section 22, with one of three fasteners, screws or rivets 25 in place to secure the belt loop assembly 20 to holster body 10. FIG. 4 illustrates the inventors' significant modification to the design of the prior art S-shaped holster belt loop assembly 20 of FIG. 2. FIG. 4 also illustrates an alternate embodiment of this invention in which the inner liner includes discrete raised segments rather than a continuing raised liner placement of the foam raised inner liner 31 relative to belt 30. In FIG. 4, the raised inner liner 31 is comprised of a series of generally square-shaped sections 39, which are attached to inside section 33 of belt 30 by any reasonable means such as by a series of vertical stitch lines. It is understood that the raised inner liner 31 may be designed in other shapes, such as rectangles or oval or circular. These shapes may be produced by selectively compressing areas of a fabric covered foam employing the process disclosed in the U.S. Pat. No. 5,351,868 of the assignee of this invention.

The holster belt loop assembly 20 has been redesigned to virtually eliminate the ridge R shown in FIG. 2*a*. With the modification of design, the belt loop assembly 20 of FIGS. 4 and 5 is less likely to exert a concentrated pressure upon the wearer's hip and/or thigh region. In fact, any pressure which may be exerted by the holster belt loop assembly 20 is more evenly distributed due to the smooth, tapered interior surface including pad 24 of several square inches in size. The contoured holster attachment section 23 of belt loop assembly 20 has an inner surface which may contact against the lower waist and hip region of the wearer when worn in the intended manner without discomfort.

FIG. 2*a* and FIG. 4 also clearly illustrate the tapered interior surface of belt loop assembly 20 having the protective pad 24 as the prime contact area as illustrated in FIG. 2(*a*) for increased comfort. Pad 24 acts to minimize, if not, eliminate pressure points which might result from belt loop assembly 20 resting against the wearer's hip and thigh regions when worn in the intended manner. The pad 24 is preferably similar in structure to the padding of the belt 30, namely a contoured foam plastic pad covered by a fabric.

Turning now to FIG. 5 which shows the holster 12 with its belt loop assembly 20 hanging from duty belt 10 and attached to holster body 13. FIG. 5 clearly illustrates the contoured shape and design of holster belt loop assembly 20, especially holster-attachment section 23, which provides more comfort to the hip and thigh region of the wearer due to the elimination of ridge R, shown in FIG. 2(*a*).

The addition of pad 24 provides a smooth continuation of the transition portion 22 and preferably is cloth covered foam similar to the pad 31 of the belt 30 as shown in FIGS. 2*b*, 3, 3*b*, and 3*c*. Pad 24 may be made from any resilient material, such as foam. Pad 24 is preferably attached to the inner surface of the holster attachment section 23 of belt loop assembly 20 by an adhesive and may be configured to fill a recess in the inner face of the belt loop assembly 20. Pad 24 is in the generally trapezoidal shape of the inner surface of holster attachment section 23 and cushions most forces, which may be exerted by holster 12, upon the wearer's waist and hip region.

The belt loop assembly 20 of FIGS. 4 and 5, especially of holster-attachment section 23, in order to include a more smoothly tapered shape and a soft, protective pad 24 does not add any significant weight to the holster assembly, as the holster belt loop assembly 20 is typically made from a rigid, lightweight plastic, and pad 24 is typically made of a cloth covered, lightweight, polyethylene foam material.

In the preferred embodiment, the holster belt loop assembly 20 is made of a rigid, lightweight plastic, and pad 24 is made of polyethylene foam/fabric laminate or EVA (EVAZOTE) foam/vinyl laminate.

Together, the ergonomic belt and its holster with its contoured, padded belt loop assembly of this invention are believed to offer a significant advance in comfort for duty belt wearer's, while maintaining the effective carriage of the duty officers handgun as well as all other required or desired accessories.

Referring again to FIG. 2*b*, which illustrates the duty belt 30 worn by an officer whose waist, torso, and clothing outline is shown by the dashed line with the holster 12 and belt 10 being worn in its intended manner. The contact face 37 of belt 30 generally rests against the wearer's waist, while the pad 24 and tapered inner surface of the holster-attachment section 23 of holster belt loop assembly 20 is also generally against the waist and soft tissue of the hip area of the wearer when the assembly 20 is worn in its intended manner. This is in contrast with prior art holsters when worn with a prior art belt.

The above-described embodiments of the present invention are merely descriptive of its principles and are not to be considered limiting. The scope of the present invention instead shall be determined from the scope of the following claims including their equivalents.

We claim:

1. An ergonomic duty belt and holster assembly for a wearer comprising:

an elongated belt body having an inner surface and an outer surface and a pair of generally parallel edges defining a belt width, a first end and a second end, wherein said first end and said second end includes means for attaching the two ends together;

said inner surface having a padded portion extending substantially from said first end to said second end except for the region of said attaching means and terminating at a contact face with a width less than the width of said belt width outer surface when said belt is worn in the intended manner and thickness at least as great as the thickness of the belt body;

said contact face being that part of said belt which may be located against the waist area of the wearer when said belt is worn around the waist in the intended manner;

a holster including a holster body having an outer face and an inner face and defining a handgun-receiving pouch and a belt loop assembly secured to the inner face of said holster body;

said belt loop assembly including a belt-attaching portion for attachment to said belt, a transition portion and a holster body attachment portion; and wherein said transitional portion includes a smooth curved inner surface extending between said belt-attaching portion and said holster body attachment portion, said inner surface transitional portion being padded;

whereby said belt contact face and said holster transitional portion cooperate to eliminate concentrated pressure against the wearer from said holster and its contained handgun.

2. An assembly as recited in claim 1 wherein the outer surface of said belt body has a vertical width of about 2¼ inches and said inner surface raised portion contact face has a vertical width of about 1½ inches when said belt is worn around the waist in the intended manner.

3. An assembly as recited in claim 1 wherein said contact face is generally rounded and extends inward toward the wearer by an amount in the order of at least one third greater than the thickness of the belt body.

4. A belt as recited in claim 1 wherein said contact face is generally flat with tapered edges and extends inward toward the wearer by an amount in the order of one third greater than the thickness of the belt body.

5. An assembly as recited in claim 1 wherein the raised portion of said inner surface is covered by fabric.

6. A belt as recited in claim 1 wherein the raised portion of said belt extends away from the inner surface of said belt body between about 5/16 inches to 7/16 inches.

7. An ergonomic duty belt and holster assembly for carrying a handgun comprising:

an elongated belt body having an inner surface and an outer surface, a pair of generally parallel edges defining its width, a first end and a second end, where said first end and said second end have a means for attaching the two ends together, and a padded liner as that part of said belt which is against the waist area of the wearer when said belt is worn in the intended manner;

said padded liner portion of said inner surface extending away from said inner surface and terminating at said contact face having a width between said parallel edges less than the width of the outer surface of said belt and of length extending substantially between said first and second ends except for the region of said attaching means;

said holster assembly including:

a holster body defining a handgun carrying pouch including;

a generally elongated belt loop assembly body having two sections, a belt-receiving section and a holster-attachment section;

said holster-attachment section having an outer face and an inner face and a means for attachment of said outer face to said holster body;

said belt-receiving section having an outer face and an inner face defining a belt opening for receiving said belt;

said inner face of said belt-receiving section and said inner face of said holster-attachment section lie generally against with the wearer's waist and hip area when the holster assembly is worn in the intended manner;

said inner face of said holster-attachment section including padding whereby said belt and holster cooperate to eliminate concentrated pressure against the wearer from said holster and its contained handgun.

8. A belt as recited in claim 7 wherein said outer surface of said belt has a vertical width of about 2¼ inches and said padded liner has a vertical width of about 1½ inches when said belt is worn in the intended manner.

9. An ergonomic holster and belt loop assembly for carrying a handgun on a belt comprising:

a holster body having an outer and an inner face and defining a handgun-carrying pouch;

a generally elongated belt loop assembly having three sections, a belt-receiving section, a transition section, and a holster-attachment section;

said holster-attachment section having an outer face and an inner face and means for attaching said outer face to a holster body;

said belt-receiving section defining a belt opening for receiving a belt;

said transition section having an outer face and an inner face;

the inner face of said belt-receiving section and the inner face of said transition section lying generally against the wearer's waist and hip area when said belt loop assembly hangs from a belt and is worn in the intended manner;

wherein the inner face of said transition section is smoothly curved and includes padding facing the wearer; and said inner face of said holster-attachment section includes padding facing the wearer such that the inner face of said transition section and the inner face of said holster attachment section cooperate to eliminate concentrated pressure against the wearer from said holster and its contained handgun.

10. A belt loop assembly as recited in claim 9 wherein said padding is covered by fabric.

11. An ergonomic holster and holster belt loop assembly comprising:

a holster body defining a handgun carrying pouch;

a generally elongated belt loop assembly body having at least a belt-receiving section and a holster-attachment section;

said holster-attachment section having an outer face and an inner face and a means for attachment of said outer face to said holster body;

said belt-receiving section having an outer face and an inner face defining a belt opening for receiving a belt;

said inner face of said belt-receiving section and said inner face of said holster-attachment section lie generally against the wearer's waist and thigh area when the holster assembly hangs from a belt and is worn in the intended manner;

said inner face of said holster-attachment section including padding in the region contacting the wearer when the holster is carried by said belt on the wearer's waist, whereby the padded inner face of said holster attachment section serves to eliminate concentrated pressure against the wearer from said holster and its contained handgun.

12. An ergonomic duty belt for carrying gear of significant weight comprising:

an elongated belt of flexible material having an outer face, an inner face, a pair of generally parallel top and bottom edges defining the width of said belt, and ends including means for securing the belt around the waist of a wearer;

the belt body of a material having strength, width, and thickness sufficient to support a load at least as heavy as a large holstered handgun;

a padded liner secured to the inner face of said belt body and of length extending substantially the length of the belt body encircling the wearer, said securing means being unpadded;

said padded liner having a width between the top and bottom which is less than the width of the belt body and a thickness at least one-third greater than the thickness of the belt body;

whereby said belt functions to eliminate concentrated pressure from said top and bottom edges against the waist of the wearer.

13. A duty belt in accordance with claim 12 wherein said padded liner has a plateau shape.

14. A duty belt in accordance with claim 12 wherein said padded liner is cloth covered.

15. A duty belt in accordance with claim 12 wherein said padded liner is divided by vertical stitch lines to produce a plurality of padded segments.

16. A duty belt in accordance with claim 12 wherein said belt body has binding on the top and bottom edges and said padded liner extends between said bindings.

17. A duty belt in accordance with claim 12 wherein said belt body has a width from the top edge to the lower edge in the order of 2¼ inch and said padded liner has a width from top edge to bottom edge thereof in the order of 1½ inch.

18. A duty belt in accordance with claim 12 wherein said belt body has a thickness in the order of 3/16-inch and said padded lining has a thickness in the order of 5/16 inch to 7/16 inch.

19. A duty belt in accordance with claim 12 wherein said padded liner is foam plastic.

20. A duty belt in accordance with claim 19 wherein said padded liner is cloth covered.

21. A duty belt in accordance with claim 20 wherein the cloth of said cloth covering is hook and pile compatible loop material.

* * * * *